US006902288B2

(12) United States Patent
Ackermann

(10) Patent No.: US 6,902,288 B2
(45) Date of Patent: Jun. 7, 2005

(54) LIGHT SOURCE SYSTEM WITH OPEN FLAMES

(76) Inventor: Dirk Karl-Heinz Ackermann, Elisabethstrasse 2, Munich (DE), 80796

( * ) Notice: Subject to any disclaimer, the term of this patent is extended or adjusted under 35 U.S.C. 154(b) by 38 days.

(21) Appl. No.: 10/604,053

(22) Filed: Jun. 24, 2003

(65) Prior Publication Data

US 2004/0057238 A1 Mar. 25, 2004

(30) Foreign Application Priority Data

Jun. 26, 2002 (DE) ..... 202 10 263 U 1

(51) Int. Cl.[7] ..... F21V 33/00

(52) U.S. Cl. ..... 362/101; 362/209; 362/227; 362/161

(58) Field of Search ..... 362/392, 810, 362/253, 209, 101, 310, 229, 227, 228, 159–161, 154

(56) References Cited

U.S. PATENT DOCUMENTS 5,086,380 A * 2/1992 Hedner, Jr. ..... 362/161
5,980,241 A * 11/1999 Schirneker ..... 431/291

* cited by examiner

*Primary Examiner*—Sandra O'Shea
*Assistant Examiner*—Hargobind S. Sawhney

(57) ABSTRACT

The light source system is a combination of two light sources with open flames that are placed in a multiple-legged, tube-like u-shaped container. The arrangement of the light sources is that one light source burns in the bottom of one leg with an upward-directed flame, and the other light source burns with a visibly downward-directed flame in the upper part of the second leg.

1 Claim, 1 Drawing Sheet

LIGHT SOURCE SYSTEM WITH OPEN FLAMES

DETAILED DESCRIPTION

Figure 1:
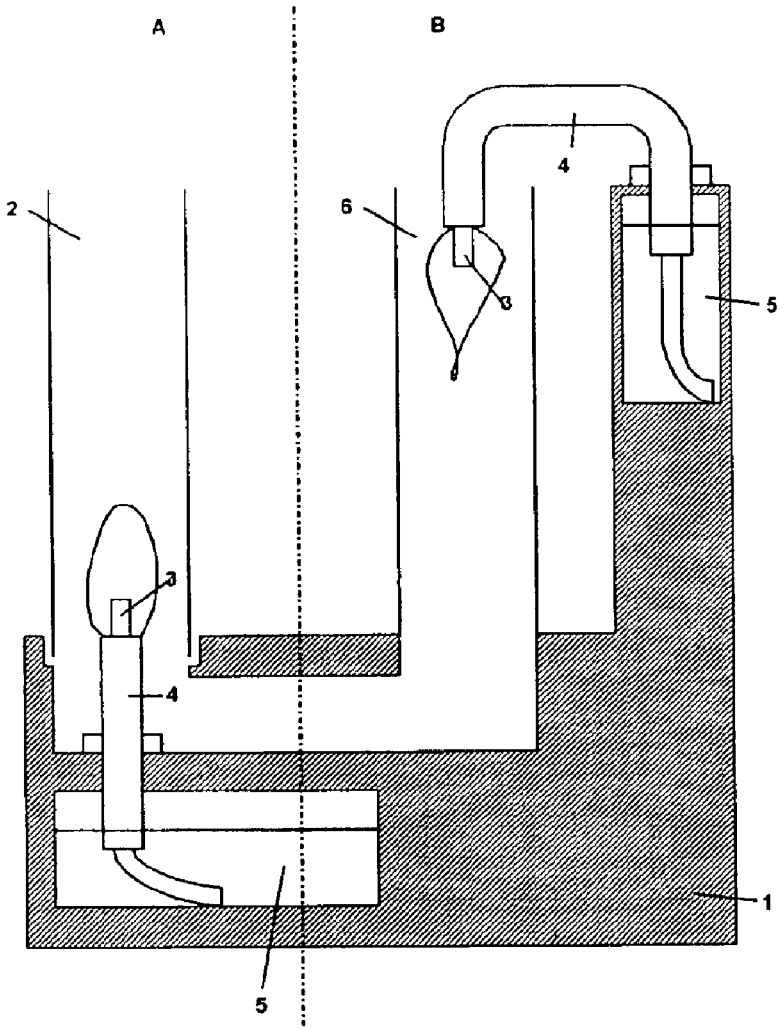

An open flame always creates a comfortable atmosphere by emitting light in the spectral range of warm colors. Because the resulting ambience is unique, you can still find such simple and archaic light sources widely spread in all domains of human life today, especially in the domestic and gastronomy sectors. Referenced in historical documents and available on today's market, you can find innumerable varieties of such light sources, however, they all have upward-burning flames.

The purpose of this patent application is to propose a new light source system which changes the flame direction from upwards to horizontal or even downwards through simple means.

The system combines at least one downward-directed open flame and at least one heat source, which can also be a light source. Each is placed in a leg of an u-shaped tube-like container where the two open ends are pointed up. In the bottom of one of these legs, an upward-directed heat source is placed, which generates an air stream through both legs. In the other leg, a downward-directed flame (light source) burns, which is pulled downwards more strongly by the air stream.

The invention is described in more detail in FIG. 1. FIG. 1 shows a possible arrangement of the components of the light source system described previously. The number (1) represents the outer body of the system, which is made of a non-flammable material such as glass. Area A stands for the oil-filled reservoir and the lit wick of the oil lamp. A first removable glass cylinder (2), placed in the Area A serves as a funnel for a first oil lamp (3) which is positioned within the first removable glass cylinder (2). This glass cylinder (2), the body (1) and the second glass cylinder (6) together form a u-shaped container. Inside the container is a heat source and a light source in this case both oil lamps consisting of wicks (3), removable wick tubes (4) and oil reservoirs (5). If the first oil lamp is lit (Area A), an upward air stream is generated in the first cylinder (2). Since the second cylinder (6) is connected to the first cylinder (2) via the body (1), a downward air stream is generated in the second cylinder (6). If the second oil lamp in the second cylinder (6) is now lit, the flame bums downwards, provided the wicks are adjusted correctly.

What is claimed is:

1. The light source system with open flame comprising: Body including at least one first transparent cylinder and at least one second cylinder; said at least one first cylinder and said at least second cylinder each having a top end open; the bottom ends of each of said at least one first cylinder and said at least second cylinder connected by a hollow body to form a U-shaped container enabling an unrestricted air stream between the two top open ends of the first and second cylinders through the hollow body; a first light source, generating light and heat, is placed at the bottom of said at least one first cylinder; said first light source generates an upward-directed air stream in said at least one first cylinder and thus an downward-directed air stream in said at least second cylinder; a second light source with open flame is positioned at the top of said at least second cylinder with the downward-directed air-stream and thus caused its flame to burn in a downward direction.

* * * * *